US005173673A

United States Patent [19]

Weigand et al.

[11] Patent Number: 5,173,673

[45] Date of Patent: Dec. 22, 1992

[54] MAGNETIC SOLENOID RESETTABLE GROUND FAULT CIRCUIT INTERRUPTER

[75] Inventors: Bruce A. Weigand, Canton; John E. Ericson, Jr., Chagrin Falls; Frank N. Carbone, S. Euclid, all of Ohio

[73] Assignee: Ericson Manufacturing Company, Willoughby, Ohio

[21] Appl. No.: 732,464

[22] Filed: Jul. 18, 1991

Related U.S. Application Data

[63] Continuation-in-part of Ser. No. 582,671, Sep. 14, 1990, which is a continuation-in-part of Ser. No. 541,818, Jun. 20, 1990.

[51] Int. Cl.[5] ..... H01H 73/00

[52] U.S. Cl. ..... 335/18; 361/42

[58] Field of Search ..... 335/18; 361/42-50

[56] References Cited

U.S. PATENT DOCUMENTS

| | | | |
|---|---|---|---|
| 3,828,288 | 8/1974 | Boyd | 335/274 |
| 4,157,520 | 6/1979 | Moates et al. | 335/230 |
| 4,409,574 | 10/1983 | Misencik et al. | 335/18 |
| 4,893,101 | 1/1990 | Robitaille | 335/18 |

*Primary Examiner*—Lincoln Donovan

*Attorney, Agent, or Firm*—Jones, Day, Reavis & Pogue

[57] ABSTRACT

A resettable switching apparatus for selectively interrupting a circuit connecting power from a first terminal to a second terminal when a ground fault occurs. The apparatus may be manually or electrically set. However, the contacts are held by a permanent magnet in the closed position such that no current is required. When a ground fault is detected, a current is generated to force the contacts to the open position.

26 Claims, 5 Drawing Sheets

MAGNETIC SOLENOID RESETTABLE GROUND FAULT CIRCUIT INTERRUPTER

This application is a continuation-in-part application of co-pending application Ser. No. 582,671 filed Sep. 14, 1990, which is a continuation-in-part of co-pending application Ser. No. 541,818 filed Jun. 20, 1990.

FIELD OF THE INVENTION

The present application relates to switching devices for interrupting one or more circuit connections, particularly power line conductors, in response to signals from ground fault protection circuitry. In particular, the invention relates to a circuit that holds the contacts in the closed position without power requirements but which releases the contacts upon the occurrence of a ground fault. The device can be reset manually or electrically.

BACKGROUND OF THE INVENTION

Ground fault protective devices used in a permanently connected installation (such as a wall box) require only that the hot or "live" conductor be interrupted in the event of a ground fault. However, in portable power equipment employing ground fault protection devices, the neutral conductor could become disconnected due to rough handling and the like and the protective circuit de-energized. A fault current between the hot conductor and ground would then go undetected through loss of the neutral conductor. This possibility has prompted U.L. to require that nonpermanently connected ground fault protective equipment in this country include means for detecting an open neutral conductor.

The means usually employed includes a separate device such as a self-latching relay that will maintain low current continuity only so long as both hot and neutral conductors are connected. These relay devices tend to be bulky and expensive and awkward for use with portable equipment.

Other known resettable circuit interrupt devices typically utilize complicated mechanisms to set and reset the contacts. These mechanical arrangements have tended to be complex and intricate because one necessary safety requirement is that the device must not be capable of being reset unless a safe circuit is present. This complexity, however, drives up manufacturing costs and reduces reliability.

Accordingly, the need exists for a resettable circuit interrupter that is simple in design, avoids complex mechanisms for actuating circuit connections and thereby provides a low cost yet reliable means for setting and resetting the device.

The apparatus disclosed in U.S. Pat. No. 4,893,101 provides such a device. While the device disclosed therein functions well, it relies solely on the absence or presence of a magnetic field provided by a predetermined minimum current in the solenoid coil. Therefore, a constant current is required through the coil to maintain the latching of the contacts in the closed position. Other methods exist in which a first current is used to close the contacts and then a second minimum current is utilized to maintain the contacts in the closed position. However, in both cases, at least a minimum current is required to hold the contacts in the closed position.

The present invention provides a device that is used as a circuit interrupter but which utilizes a magnetic coupling to hold the contacts in the closed position and has no power consumption except during the time the contacts are disengaged which, of course, lasts for only a few milliseconds. Further, the contacts will remain closed even if the power is removed and thus the device is unaffected by loss of power. However, appropriate circuitry may be added that causes the contacts to be opened in the event power is removed. The solenoid contacts may be either mechanically or electrically reset. The device can be used with extremely wide ranges of voltage without changing windings. Further, the solenoid and contacts are capable of conducting large amounts of current and yet are easily mounted on a printed circuit board.

Since the operation of the device relies solely on the presence of magnetic coupling, no mechanical or electrical latching arrangement is necessary. Therefore, minimum power is required to operate the device.

In another embodiment, minimum current is applied to the solenoid coil to create a magnetic field that is added to the magnetic field caused by the permanent magnet footplate to hold the contacts closed. In this embodiment, the conjunction of the magnetic field caused by the magnetic footplate with the magnetic field caused by the minimum current allows a much less current to be used in the bobbin than in the case such as disclosed in U.S. Pat. No. 4,893,101.

In still another embodiment, a standoff platen is added to the solenoid to prevent the contacts from being closed manually when at reset to prevent the solenoid from having chatter or buzzing.

SUMMARY OF THE INVENTION

Thus, the present device relates to resettable switching apparatus for selectively interrupting circuit contacts connecting power from a first terminal to a second terminal when a ground fault occurs, the apparatus comprising at least first and second contacts, one of the contacts being movable and the other fixed, first means for holding the contacts in their normally open position, second means for enabling closing of the contacts and holding the contacts in the closed position with magnetic attraction, and third means associated with the first and second means for generating a magnetic field greater than and opposing the magnetic attraction of the second means only when the ground fault occurs so as to open the contacts and return the movable contact to the open position.

The invention also relates to a method for selectively interrupting circuit contacts connecting power from a first terminal to a second terminal when a ground fault occurs comprising the steps of biasing a fixed and a movable contact in the normally open position, selectively closing the biased contacts and holding the contacts in the closed position only with a first magnetic attraction when it is desired to connect the power from the first terminal to the second terminal, and generating a second magnetic field greater than and opposing the first magnetic attraction only when a ground fault occurs to enable the biased contacts to be returned to the normally open position.

The invention also relates to resettable switching apparatus for selectively interrupting circuit contacts connecting power from a first terminal to a second terminal when a ground fault occurs, said apparatus comprising at least first and second contacts, one of the contacts being movable and the other fixed, first means for holding the contacts in a normally open position, means for closing the first and second contacts, a permanent magnet having insufficient magnetic field strength, alone, to hold the first and second contacts closed, means for electrically generating a magnetic field which in combination with the magnetic field of the permanent magnet is sufficient to hold the first and second contacts in the closed relationship, and means for interrupting the electrically generated magnetic field to open the first and second contacts when a fault occurs.

BRIEF DESCRIPTION OF THE DRAWINGS

These and other objects of the present invention will be more clearly understood in conjunction with the accompanying drawings in which like numerals represent like elements and in which.

DETAILED DESCRIPTION OF THE DRAWINGS

Figure 1:
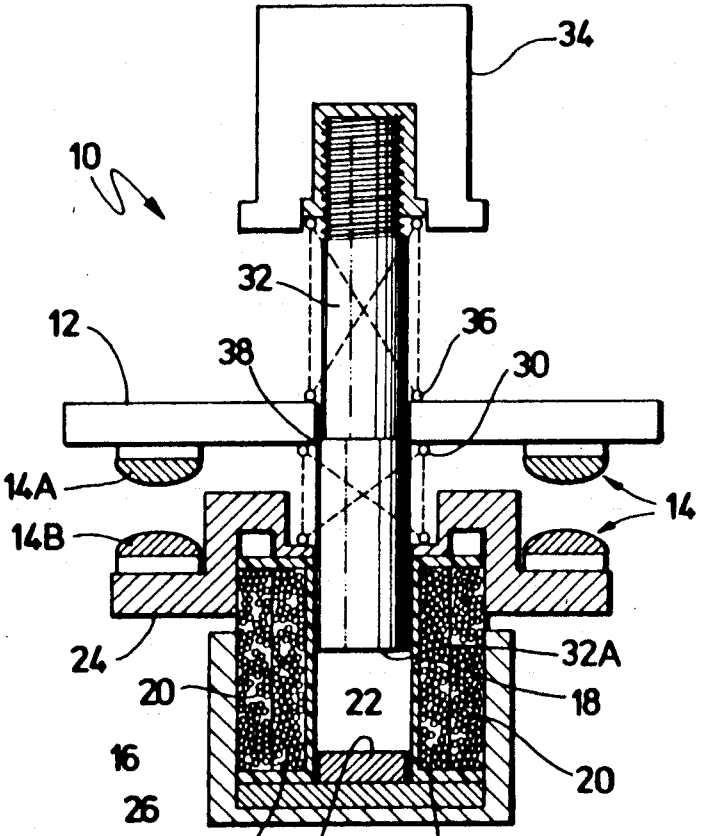
FIG. 1 is a cross-sectional view of the device of the present invention with the device shown in the deactivated or open contact state.

With reference to FIG. 1, a circuit interrupt device embodying the present invention is generally indicated with the numeral 10. The device 10 is depicted being used in a typical manner such as mounted on a printed circuit board 12 for use as part of a ground fault protection circuit shown in FIG. 3 and described hereafter.

The device 10 includes one or more pairs of electrical contacts 14 (2 pair are shown in FIG. 1). The contacts may be used to connect power to protected portable power equipment. One contact 14A of each contact pair is preferably mounted on the circuit board 12 and is hereinafter referred to as the "fixed" contact 14A. The other contact 14B of each contact pair is movable relative to its corresponding fixed contact in a manner described hereinbelow.

The device 10 further includes a cylindrical or rectangular housing 16 that retains and preferably substantially encloses a solenoid coil bobbin 18. The bobbin 18 has wire coils 20 wound thereon to form a solenoid with an open concentric central passageway 22 therethrough. The coil bobbin 18 and the coil 20 are adapted to slide easily within the housing 16. Coil 20 may be connected to ground fault detection circuitry.

A contact carrier 24 is attached to one end of the bobbin 18 with each movable contact 14B mounted thereon opposite its corresponding fixed contact 14A. The opposite or distal end of the bobbin 18 has a flange 26. A metal footplate 28 is attached to the flange 26. The relative positions of the movable contacts 14B with respect to the fixed contacts 14A are such that when the bobbin 18 is seated at the bottom of the housing 16 as in FIG. 1, the contacts are electrically open. However, the bobbin 18 can slide sufficiently upward or axially so as to cause closure of the contacts 14 as will be further explained.

A compression bias spring 30 is positioned between the circuit board 12 and the bobbin 18 so as to exert an axial force on the bobbin. This force tends to move the bobbin 18 towards the bottom of the housing 16, thereby opening the contacts 14. Thus the contact pairs 14 are said to be "normally open".

A plunger 32 is provided with a convenient manual actuation knob 34 at one end. The plunger 32 is arranged so as to slide within the passageway 22 through the solenoid. A plunger return spring 36 is disposed between the knob 34 and the circuit board 12 and exerts a force that tends to shift the distal end of the plunger 32 up or away from the bottom of the housing 16 and also privide pressure to make positive electrical contact. A shoulder 38 is provided on the plunger 32 to abut the circuit board 12 when the plunger is in the up position, thereby preventing the plunger 32 from dropping out of the device 10. When the plunger 32 is manually actuated by applying an axial force to the knob 34, the plunger 32 is pushed until the distal end 32A thereof contacts or engages the footplate 28. The plunger 32 is a permanent magnet and will connect with the footplate 28 and hold itself in that position.

Figure 2:
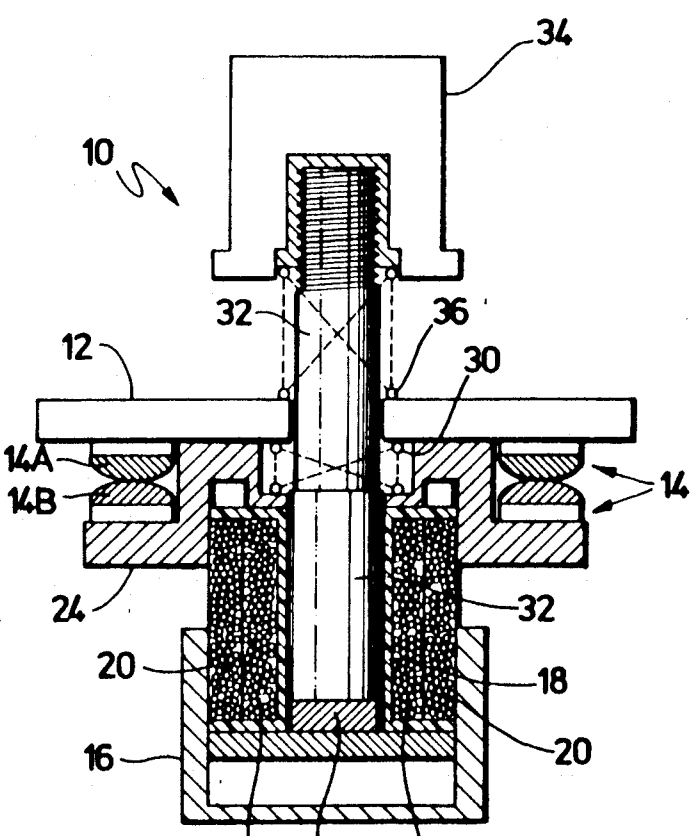
FIG. 2 is a view similar to that of FIG. 1 but with the contacts in the closed state.

Operation of the device 10 is as follows. When the plunger 32 is manually actuated by pushing the distal end 32A into contact with the footplate 28, the plunger 32 and the footplate 28 are magnetically coupled because the plunger 32 is a permanent magnet. As shown in FIG. 2, when the manual force is released, the spring 36 tries to return the plunger 32 to its original position and the footplate 28, bobbin 18 and contact carrier 24 are likewise moved with the plunger 32 thereby closing the contacts 14.

Because the plunger is a permanent magnet, no current is required to hold the contacts in the closed position. With no current at all through the coil 20, the contacts will remain in the closed position. The device cannot be reset until the magnetic coupling caused by the permanent magnet plunger is overcome. This is accomplished by passing a current in the proper direction through the solenoid bobbin windings 20 which will momentarily magnetize the solenoid. When current of sufficient value is passed through the bobbin windings, the magnetic poles of the footplate 28 and the magnetic plunger 32 will oppose each other serving to release the magnetic connection previously made. The spring 30 will push the entire bobbin and carrier downward and spring 36 will move the plunger away from the bobbin and carrier, thus opening the contacts 14. The plunger 32 is then in the position shown in FIG. 1 and is too far away from the footplate 28 to make magnetic connection therewith. Resetting of the device occurs by forcing the plunger 32 with solenoid bobbin current removed against spring 36 into the bobbin sufficiently far to make magnetic contact with footplate 28, whereupon the device again assumes the configuration illustrated in FIG. 2.

If it is desired to electrically reset the device instead of manually, a second coil 20A may be wound upon the bobbin 18 shown in FIGS. 1 and 2. When a sufficiently large current is passed through coil 20A, it will create a magnetic field that is attracted to the magnetic plunger 32, thus pulling the magnetic plunger into the bobbin sufficiently far to enable the permanent magnet to contact the footplate 28 and thus magnetically lock the plunger 32 to the footplate 28. The current through coil 20A need only be a momentary current sufficient to cause the magnetic engagement to take place. Once that occurs, the current can be removed and the device functions as previously explained.

Figure 3:
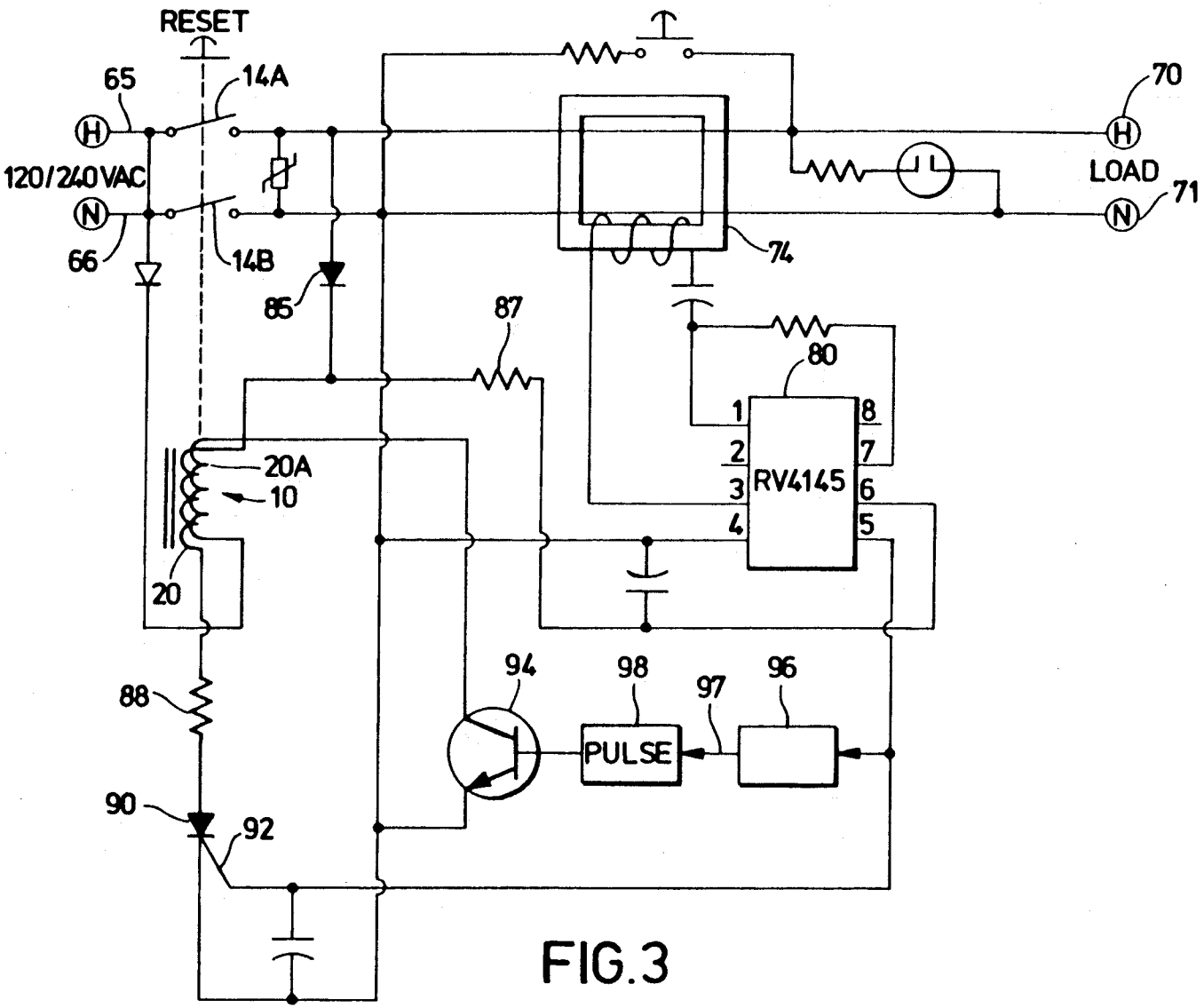
FIG. 3 is a schematic diagram of a control circuit for the device in FIGS. 1 and 2.

In operation, the device 10 of FIGS. 1 and 2 is connected in the circuit of FIG. 3. In FIG. 3, line terminals 65 and 66 representing "hot" and "neutral" lines are intended for connection to a conventional AC outlet. Power is provided through terminals 65 and 66 and contacts 14A and 14B of device 10 to terminals 70 and 71 connected to a protected piece of power equipment. A current transformer 74 is provided to sense current flow between the neutral line and the hot line in a well-known manner to indicate a ground fault. If any such ground fault current is sensed by transformer 74, a signal is provided to an integrated circuit 80, which in turn provides a signal on pin 5 indicating that a ground fault has been sensed. Preferably, integrated circuit 80 is a GFCI controller manufactured by Ratheon as part No. RV4145.

Power is supplied to the ground fault control circuit from terminals 65 and 66 through a diode 85. The output of diode 85 is supplied to the solenoid coil 20 and to current limiting resistor 87 which is connected to the power input pin 6 of the integrated circuit 80.

The other end of coil 20 of the solenoid assembly is coupled to resistor 88 and silicon control rectifier 90. The output of pin 5 from the integrated circuit 80 is the ground fault signal that is coupled to the gate 92 of the silicon control rectifier 90. If a ground fault signal appears, it causes gate 92 to have silicon control rectifier 90 (SCR) conduct. In that case, the current through the SCR 90, diode 85 and coil 20 causes coil 20 to provide sufficient current to produce a magnetic field that opens contacts 14A and 14B as explained earlier. When the power is removed from diode 85 by the opening of the contacts 14A and 14B, the solenoid assembly is deactivated and the solenoid remains in the open position. The solenoid can be manually or electrically reset as desired.

If it is desired to automatically reset the contacts when the fault has been cleared, a second coil 20A may be wound on bobbin 18 in a direction opposite to coil 20. One end of coil 20A can be connected to hot line 65 at a point before contact 14A and the other end of coil 20A may be connected to the transistor 94. Transistor 94 is normally in the off position and thus no current can pass through coil 20A. However, when the ground fault has been cleared, the decay of the signal from line 5 is detected by edge detector 96 in a well-known manner and a signal is produced on line 97 to a pulse generator 98. Pulse generator 98 is any well-known device such as a monostable multivibrator which produces only a single output pulse with an input signal. The output pulse from the pulse generator 98 is coupled to the gate of transistor 94, thus causing it to conduct. The current then passing through coil 20 is sufficient to create a magnetic field that causes the solenoid to attract magnetic plunger 32 and pull it sufficiently into the bobbin to enable it to magnetically attach to footplate 28. The current through coil 20A is for a few milliseconds only and is then removed when the pulse from pulse generator 98 decays. The circuit is then reset and operates until the next ground fault occurs when the procedure is repeated as set forth previously. A single winding coil solenoid with circuitry to pulse current in either direction could be employed to reset and set the solenoid assembly and open or close its contacts.

Thus the invention described herein achieves a resettable circuit interruption device that holds the contacts in the closed position with a permanent magnet thus requiring no current flow during the normal operation of the circuit. When the circuit has a ground fault, a momentary current causes the contacts to open. Thus the device consumes little power. It can be reset manually or, if desired, a second coil may be wound on the solenoid bobbin and, when the ground fault has been cleared, a current is provided momentarily of sufficient magnitude to cause the permanent magnet plunger to be moved sufficiently close to the footplate to enable a magnetic contact to be made. The current is then removed from the second coil and the device operates as previously described. Thus the device is simple and economical to manufacture and is economical to operate because of the low power consumption.

The solenoid shown in FIGS. 1 and 2 may be used in a second embodiment of the invention. In the second embodiment, the magnetic plunger 32 is constructed so that it does not have sufficient magnetic strength to lock itself to footplate 28 when the plunger is manually depressed. The bias springs 30 and 36 overcome the magnetic attraction between the magnet 32 and the footplate 28 and prevent the contacts from staying closed. However, upon energizing the bobbin coil in order to electrically generate a magnetic field that is cooperatively associated with the magnetic field of permanent magnet plunger 32, the two magnetic fields in combination are sufficiently strong to hold the first and second contacts in a closed relationship against the opposing forces of bias springs 30 and 36. Thus with the bobbin coil 20 being energized, the additional magnetic force provided by the bobbin coil 20 in combination with the magnetic field of the existing permanent magnet 32, is sufficient to simultaneously pull the plunger 32 toward the footplate 28 and pull the solenoid assembly up to meet the plunger 32. The return spring 36 will then bring the entire assembly up so as to close the contacts 14A and B as described earlier. Upon de-energizing the bobbin, the assembly will return to the position illustrated in FIG. 1 because the permanent magnet is not sufficient by itself to remain attached to footplate 28 against the force of the bias spring 30 and plunger return spring 36.

This circuit is advantageous in that it will operate with much less heat than the circuits which use a minimum current such as that disclosed in U.S. Pat. No. 4,893,101 because most of the magnetic force needed for operation is provided by the permanent magnet instead of 100 percent by electric field generated by the bobbin.

Figure 4:
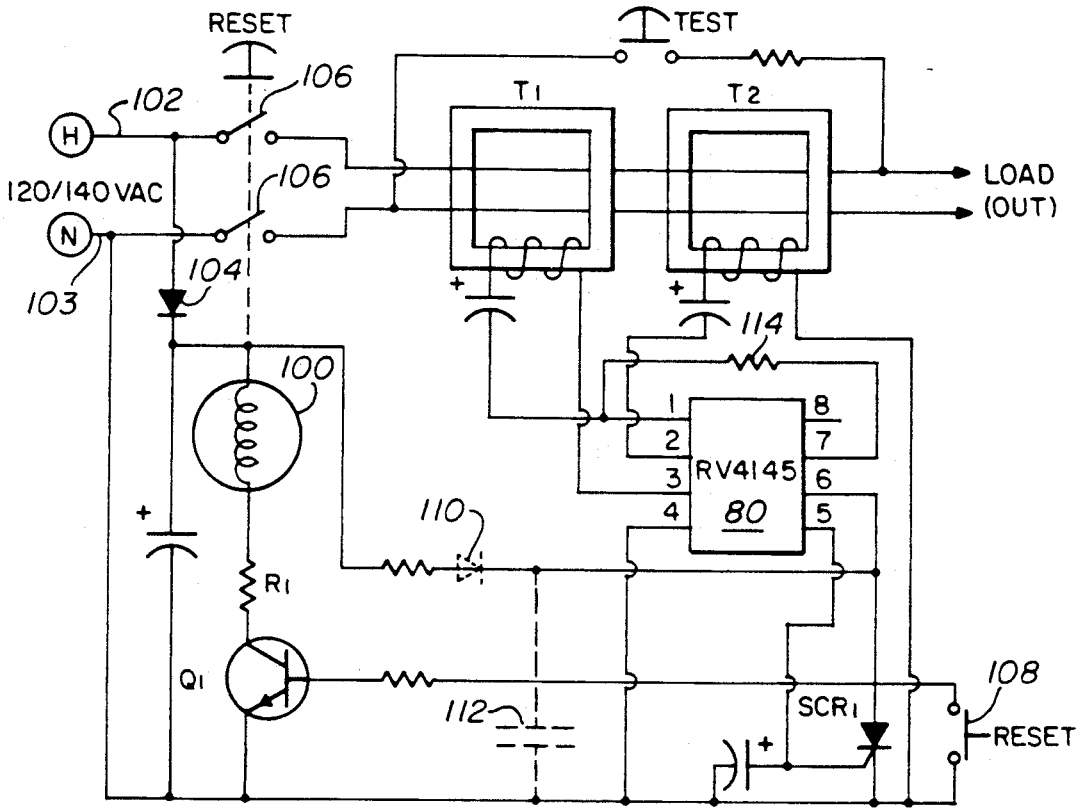
FIG. 4 is a diagram of an alternate electrical reset circuit that can be used with the solenoid of FIGS. 1 and 2.
Figure 7:
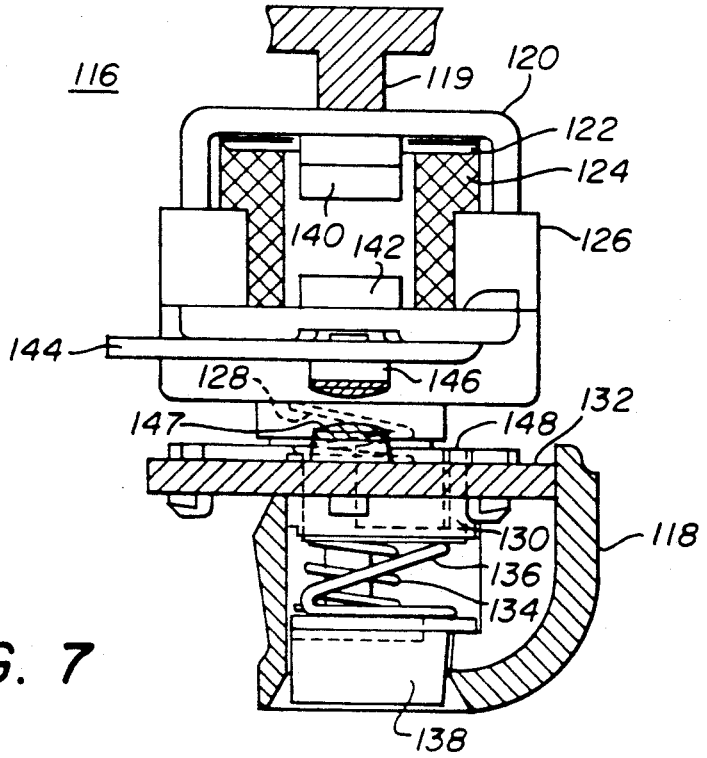
FIG. 7 is a partial schematic of an alternate embodiment of a solenoid which has a permanent magnet as a footplate and which has a standoff platen to prevent chattering of the solenoid in the event it is attempted to be manually reset or electrically reset during the time a fault is existing.
Figure 8:
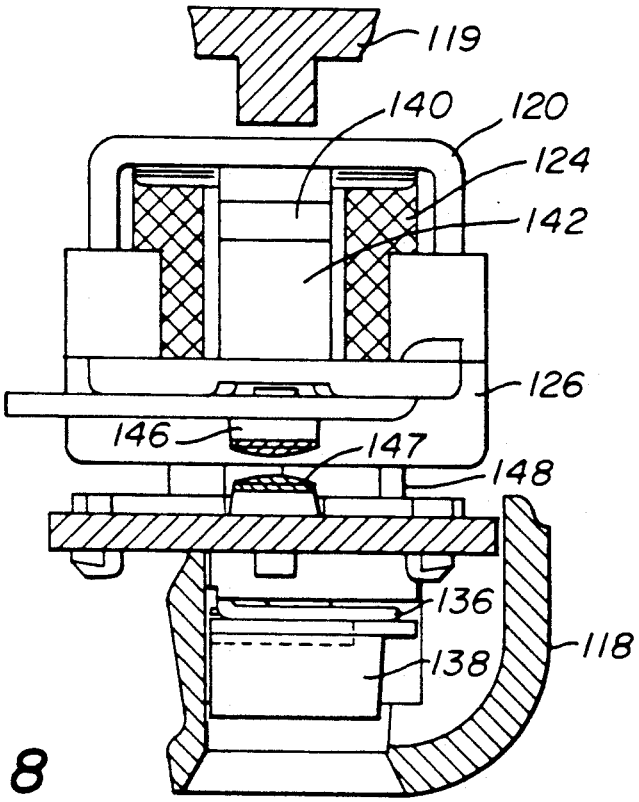
FIG. 8 is another partial cross-sectional view of the solenoid of FIG. 7 wherein the manual reset button has been depressed.
Figure 9:
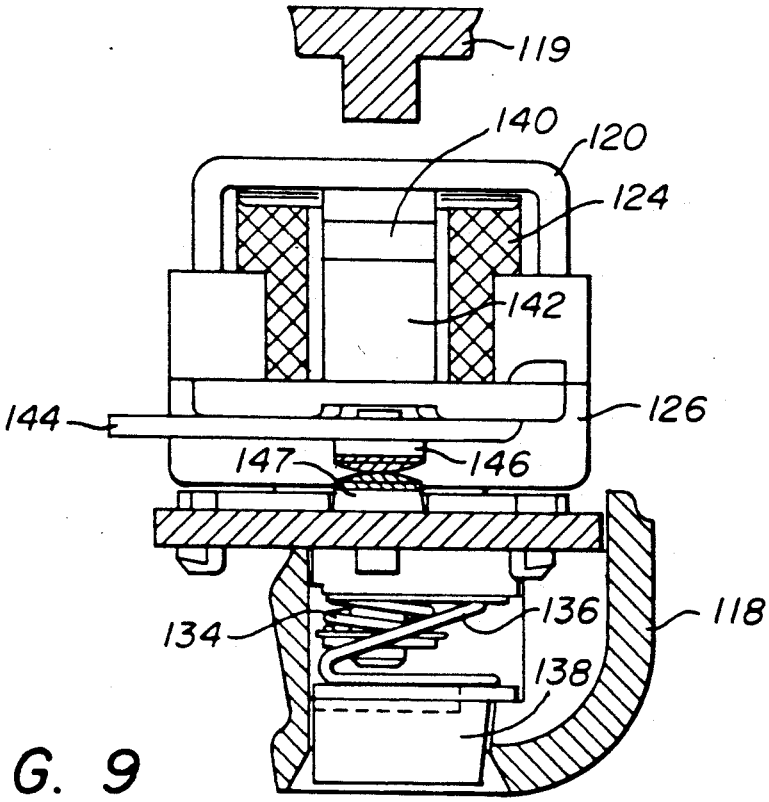
FIG. 9 is a partial cross-sectional view of the solenoid shown in FIGS. 7 and 8 and in which the contacts are closed but the manual reset button has returned to its normal operating position.

The circuit shown in FIG. 4 may be used with the solenoid shown in FIGS. 1 and 2 and in FIGS. 7, 8 and 9 to electrically reset and power up reset the solenoids. It cannot be used with the mechanical reset version.

When power is supplied to terminals 102 and 103 of the circuit shown in FIG. 4, current flows through diode 104, solenoid coil 100, resistor R1 and transistor Q1. The solenoid coil 100 is then energized and will provide just enough additional magnetic pull to supplement the existing permanent magnet's pull force to close the contacts 106. The resistor R1 will limit the current sufficiently to a point of magnetic strength within the solenoid coil 100 to accomplish this. To disengage the contacts 106, SCR1 will receive a signal from pin 5 of integrated circuit chip 80 indicating a ground fault. This signal will cause SCR1 to conduct, thus turning off transistor Q1 and preventing current flow through coil 100. Thus, the contacts 106 open because the pull of the permanent magnet is not sufficient alone to keep the contacts 106 closed. SCR1 will remain in conduction, thus keeping transistor Q1 off, until the current flow through SCR1 is stopped. This can be accomplished by momentarily pressing the reset button 108. When transistor Q1 conducts again, the current through solenoid coil 100 will be sufficient to assist the pull of the permanent magnet to close the contacts 106. Capacitor 112, shown in phantom, may be added to smooth out the pulsating DC caused by the diode 104. This enables more accurate adjustment of circuit elements such as resistor 114 because the voltage is smoother. Diode 110, shown in phantom, may also be added to allow a smaller capacitor 112 to be used because diode 110 prevents the capacitor 112 from discharging through the solenoid coil 100.

Figure 5:
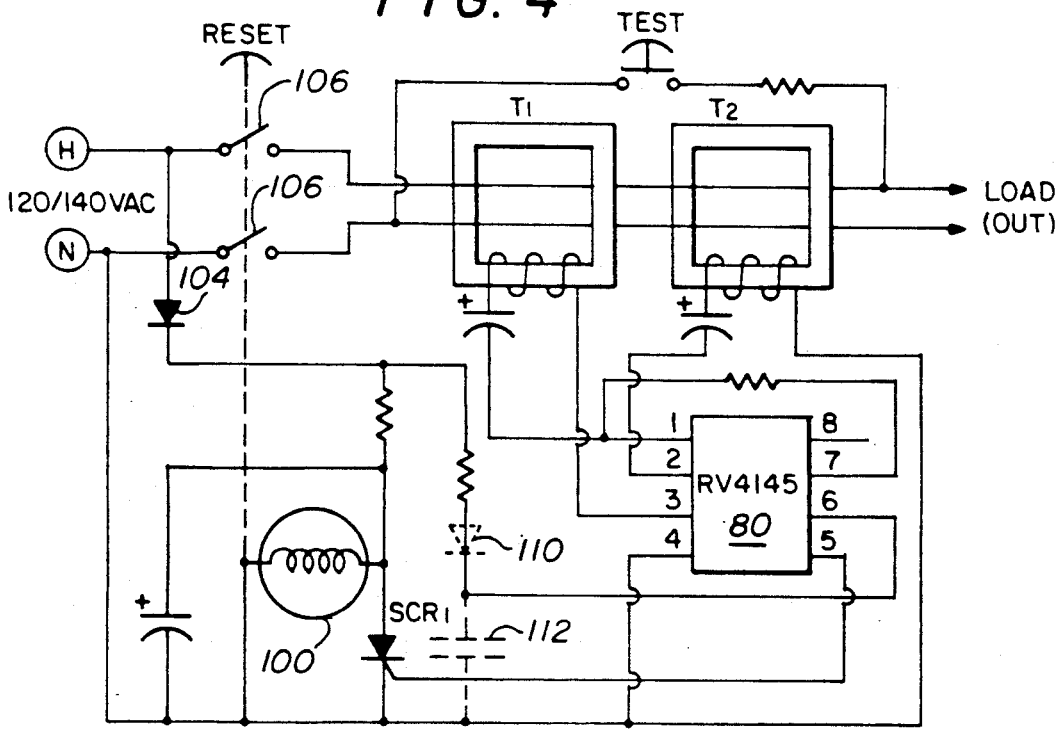
FIG. 5 is a diagram of an alternate circuit embodiment which can be used with a solenoid that is manually reset.

The circuit shown in FIG. 5 provides a manual reset capability for the contacts 106. As previously described, the solenoid coil 100 adds to the magnetic pull of the permanent magnet in the solenoid and will keep the contacts closed. To disengage the contacts 106, current flow through the solenoid coil 100 must be interrupted. This is accomplished by turning on SCR1 with a signal from pin 5 of the integrated circuit 80 whenever a fault occurs. At that time, the solenoid coil 100 will be shunted by SCR1 and will disengage. Since a half-wave rectifier 104 is utilized, SCR1 will turn off automatically after one-half cycle. The plunger in the solenoid is sufficiently short enough (the distance from the face of the footplate to the face of the plunger) to prevent re-energizing upon return of current through the coil which will occur immediately after SCR1 turns off. To reset, one must manually push the plunger into the bobbin until magnetic engagement is accomplished. Then the combined force of the permanent magnet and the current through coil 100 will maintain the contacts closed until another fault occurs.

Figure 6:
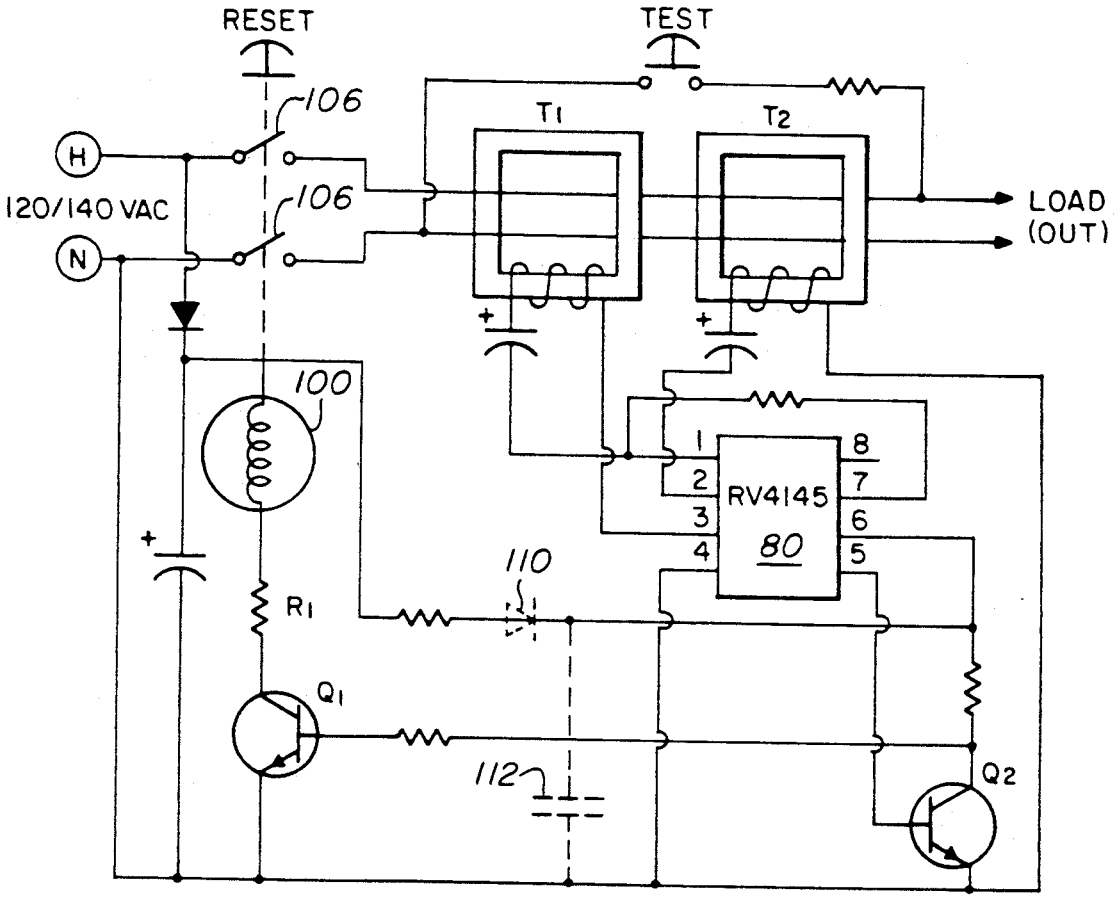
FIG. 6 is a diagram of another alternate circuit embodiment that can be used with a solenoid that is manually reset.

An alternate manual reset version is illustrated in FIG. 6. The solenoid 100 is turned on as described previously with current passing through the solenoid and creating a magnetic field that adds to the pull of the permanent magnet in the solenoid to hold the contacts closed. In this case, the solenoid 100 is turned off by turning off transistor Q1. This is accomplished when a fault occurs and a signal on line 5 from integrated circuit 80 is coupled to Q2 to turn Q2 on. When Q2 is turned on it will ground the base of transistor Q1 and turn it off, thus interrupting the current flow through the solenoid coil 100 and opening the contacts 106. Thus, the contacts open because the pull of the permanent magnet in the solenoid is not sufficient alone to hold the contacts closed. After the fault is removed, the signal is removed from Q2, Q1 will turn back on and current will again flow through solenoid coil 100. However, as described previously, the current alone is insufficient to reset the contacts 106. To reset, the solenoid plunger must be manually inserted into the bobbin until magnetic engagement is obtained where, again, the combination of the magnetic pull of the permanent magnet and the magnet pull generated by the solenoid coil will hold the contacts in the closed position.

When the plunger is formed of a magnetic material and is used as a permanent magnet to hold or assist in holding the contacts closed, a disadvantageous result may occur. Because the plunger is positioned in the strongest part of the generated magnetic field, it may lose its magnetism because of the strong, opposite polarity, magnetic field generated by the bobbin. Thus, it is advantageous to use a permanent magnet as the footplate because the footplate sits in the weakest portion of the generated field and is less likely to have its magnetism adversely altered by a generated magnetic field.

FIG. 7 is an alternate embodiment of a solenoid 116. It is mounted in a frame 118 and has a metal U-frame 120 in which a bobbin wire form 122 is mounted and on which electrical windings 124 are wound. A contact carrier support insulator assembly 126 carries a movable current carrying contact 146. A carrier bias spring 128 holds the carrier support assembly 126 away from the support substrate 132 which carries a stationary contact 147 on an insulator 149. A reset button 138 is in contact with a plunger 142 such that when the reset button 138 is depressed, it forces the plunger 142 towards a high-grade permanent magnet footplate 140. Plunger 142 is made of any well-known permeable material that will carry the lines of force of a magnetic field. A plunger return spring 134 tends to hold the plunger 142 in an initial position before reset button 138 is depressed. A standoff platen 130 is mounted in the support substrate 132 and is resiliently biased towards the contact carrier support insulator assembly 126 by a reset check spring 136, which also aids in holding the reset button 138 and plunger 142 in an initial position. Electrical connection 144 couples to the AC load for applying power to bobbin windings 124.

In operation, when the reset button 138 is depressed, it compresses plunger return spring 134 and reset check spring 136 and forces plunger 142 towards the high-grade permanent magnet 140. The high-grade permanent magnet 140 may be made sufficiently strong to maintain the plunger 142 in contact therewith after reset button 138 is released, as explained previously, or it may be made sufficiently weaker such that when plunger 142 has been fully depressed it requires an additional current flowing through windings 124 to hold the contacts in the closed position. It would function properly in either event. When reset button 138 is depressed, it also depresses the standoff platen 130 by the reset check spring 136. The vertical finger or projection 148 forming part of the standoff platen 130 contacts the carrier support insulator assembly 126 as illustrated in FIG. 8, thus preventing contacts 146 and 147 from closing even though the plunger is fully in contact with the permanent magnet 140 as shown in FIG. 8. The purpose for the standoff platen 130 is to prevent chattering of the contacts 146 and 147 if a reset is attempted while a ground fault exists. If it were not for standoff platen 130, when the reset button 138 is depressed or the solenoid is electrically reset, the contacts 146 and 147 would close, the ground fault circuit would kick in if a ground fault is present and open the contacts, they would immediately close again and then reopen and consequently the contacts would chatter at a 60-cycle rate. The standoff platen 130 keeps the contacts from closing while the reset button is held depressed and thus chattering cannot take place. Once the pressure is removed from the reset button 138, the check spring 136 returns the reset button 138 to its fully extended position and, if the ground fault still exists, the contacts simply open again and there is no chattering of the relay contacts 146 and 147. The contacts 146 and 147 are then shown in FIG. 9 in their closed position with the reset button 138 returned to its normal position and the solenoid in its normal operating position.

Thus, the chief benefits of the solenoid shown in FIGS. 1, 2, 7, 8 and 9 (in the embodiment in which the permanent magnet is of such a force as to be able to hold the contacts together once the solenoid contacts are closed) are that no power consumption is used except during disengaging the contacts which lasts only a few milliseconds, the relay is unaffected by loss of power and the contacts will remain closed even if the power is removed, but, with appropriate circuitry, can open upon loss of power. The solenoid and contacts are mechanically reset (but with appropriate circuitry can be electrically reset), the solenoid can be used in extremely wide ranges of voltages without changing the windings, and the solenoid and contacts are capable of conducting large amounts of current and yet are easily mounted on a printed circuit board.

The solenoid version in FIGS. 7, 8 and 9 has the advantage of using a floating bobbin/contact assembly and a permanent magnet that provides full-time magnetic biasing and is not demagnetized with a reverse current. The unit is both electrically and mechanically resettable and settable and the electrical pulses for operation need no conditioning and work the same for set or reset.

The circuits shown in FIGS. 4, 5 and 6 are advantageous in that they allow an automatic opening of the contacts of the solenoid upon the occurrence of a ground fault and yet allow either mechanical or electrical resetting of the solenoid contacts. As explained earlier, FIG. 4 is an electrical reset version of a circuit that can be used with the solenoids disclosed herein. In summary, the circuit in FIG. 4 will automatically close the contacts when voltage is supplied to the input terminals. The current flowing through the solenoid coil, in conjunction with the pull of the permanent magnet in the solenoid, will close the contacts. Upon occurrence of a fault, SCR1 will conduct thus turning off transistor Q1 which stops the current flow through the solenoid and opens the contacts. When the reset button 108 is momentarily depressed, SCR1 stops conducting, and when the button is released, Q1 will turn on again allowing current to flow through the solenoid and thus reset the contacts.

Thus, the circuits illustrated in FIGS. 4–6 allow both mechanical and electrical resetting of the relay contacts after a fault is removed. In addition, the novel relay disclosed in FIGS. 7–9 has a floating bobbin/contact assembly and a permanent magnet that provides full-time magnetic biasing. The unit is both electrically and mechanically resettable and settable.

Where the permanent magnet is sufficiently strong and sufficiently close to the plunger, when the plunger is depressed it will close and hold the contacts in closed position, and there is no power consumption except during disengaging the contacts as in the case of a fault which lasts only a few milliseconds. Further, such relay is unaffected by loss of power. The contacts will remain closed even if the power is removed but, as illustrated, with appropriate circuitry, the contacts can open upon loss of power if a magnetic assist current is supplied to the bobbin coil as explained earlier.

The solenoid and thus the contacts can be mechanically reset or, with appropriate circuitry, can be electrically reset. Further, the novel solenoids disclosed herein can be used in extremely wide ranges of voltages without changing windings. These solenoids and their contacts are capable of conducting large amounts of current and yet they are easily mounted on printed circuit boards.

While the invention has been shown and described with respect to particular embodiments thereof, this is for the purpose of illustration rather than limitation, and other variations and modifications of the specific embodiment herein shown and described will be apparent to those skilled in the art all within the intended spirit and scope of the invention. Accordingly, the patent is not to be limited in scope and effect to the specific embodiment herein shown and described nor in any other way that is inconsistent with the extent to which the progress in the art has been advanced by the invention.

What is claimed is:

1. Resettable switching apparatus for selectively interrupting circuit contacts connecting power from a first terminal to a second terminal when a ground fault occurs, the apparatus comprising:

at least first and second contacts, one of the contacts being movable and the other fixed;

a solenoid housing carrying the movable contact;

first spring means for biasing the solenoid housing away from the fixed contacts for holding the contacts in a normally open position;

a metal footplate in the solenoid housing;

a plunger having a substantially uniformly solid cross section forming the permanent magnet and extending through the structure and slidably mounted in the solenoid housing and having insufficient strength alone to overcome the first biasing means and hold the contacts closed by magnetic attachment to the footplate but which when combined with an electrically generated magnetic field holds the contacts closed;

magnetic field generating means associated with the manually operated plunger for electrically generating a magnetic field which in combination with the magnetic field of the permanent magnet is sufficient to hold the first and second contacts in the closed relationship; and circuit interrupting means for interrupting the electrically generated magnetic field to open the first and second contacts when a fault occurs.

2. Resettable switching apparatus for selectively interrupting circuit contacts connecting power from a first terminal to a second terminal when a ground fault occurs, the apparatus comprising:

at least first and and second contacts, one of the contacts being movable and the other fixed;

a structure carrying the fixed contact;

a solenoid housing carrying the movable contact;

first spring means biasing the solenoid housing away from the structure to hold the contacts in a normally open position;

a metal footplate in the solenoid housing;

a permanent magnet attached to the metal footplate;

a plunger of magnetically permeable material of substantially uniformly solid cross section extending through the structure and slidably mounted in the solenoid housing, the permanent magnet having insufficient strength alone to overcome the first biasing means and hold the contacts closed by magnetic attachment of the plunger to the footplate;

circuit means associated with the manually operated plunger for electrically generating a magnetic field which in combination with the magnetic field of the permanent magnet is sufficient to hold the first and second contacts in closed relationship; and means for interrupting the electrically generated magnetic field to open the first and second contacts when a fault occurs.

3. Apparatus as in claim 1 wherein the means for electrically generating the magnetic field comprises a coil forming the solenoid for receiving a current when the contacts are manually closed, the current electrically generating a magnetic field sufficient only in combination with the magnetic field of the permanent magnet to hold the closed contacts in the closed position.

4. Apparatus as in claim 3 wherein the magnetic field interrupting means comprises:

means for generating a fault signal; and means using the fault signal to stop current flow through the solenoid coil and removing the electrically generated magnetic field so a to open the contacts against the opposition of the permanent magnet.

5. Apparatus as in claim 3 further comprising means associated with said manually operated means for preventing said contacts from closing until said reset button is released.

6. Resettable switching apparatus for selectively interrupting circuit contacts connecting power from a first terminal to a second terminal when a ground fault occurs, said apparatus comprising:

at least first and second contacts, one of the contacts being movable and the other fixed;

spring operated means for holding the contacts in their normally open position;

a permanent magnet plunger having a uniformly solid cross section for enabling closing of the contacts solely with manual force and without the use of current and for holding the contacts in the closed position solely with the permanent magnet; and electromagnetic means associated with the spring means and the permanent magnet plunger for generating an electromagnetic attraction greater than and opposing the magnetic attraction of the permanent magnet only when the ground fault occurs so as to open the contacts and return the moveable contact to the open position.

7. Apparatus as in claim 6 wherein said spring operated means comprises:

a structure carrying the fixed contact;

a solenoid housing carrying the moveable contact; and a first spring biasing the solenoid housing away from the structure to hold the contacts in the normally open position.

8. Apparatus as in claim 7 further including:

a footplate of magnetic material in the solenoid housing; and a second spring external to the solenoid housing biasing the permanent magnet plunger away from the footplate, the second biasing spring being stronger than the first biasing spring such that when the plunger is momentarily forced against the footplate, the magnetic attraction between the footplate and the permanent magnet plunger solely holds the solenoid housing in fixed relation with the plunger causing the housing and the moveable contact to be forced by the second biasing spring toward and in contact with the fixed contact.

9. Apparatus as in claim 7 wherein the second electromagnetic means comprises:

a winding forming the solenoid for receiving a current only when a ground fault occurs, said current causing a magnetic field opposing and greater than the sole magnetic attraction between the permanent magnet plunger and the footplate so as to enable the first biasing means to move the housing away from the structure and open the contacts.

10. Apparatus as in claim 8 wherein the contacts are closed by manually forcing the magnetic plunger against the footplate.

11. Apparatus as in claim 8 wherein the contacts are closed by electrically forcing the movable plunger contacts against the fixed contacts.

12. Apparatus as in claim 11 wherein said first spring biasing means comprises a first spring placed between the structure and the solenoid housing to bias the solenoid housing away from the structure to hold the contacts in the normally open position.

13. Apparatus as in claim 12 where said second biasing spring comprises a second spring placed between the plunger and the structure to bias the plunger away from the footplate in the solenoid housing.

14. A method of selectively interrupting circuit contacts connecting power from a first terminal to a second terminal when a ground fault occurs, the method comprising the steps of:

biasing a fixed contact and a moveable contact on a housing in the normally open position;

selectively and manually closing the biased contacts without the use of current and holding the contacts in the closed position only with a first magnetic attraction of the base of the housing with a permanent magnet plunger having a uniformly solid cross section when it is desired to connect the power from the first terminal to the second terminal; and generating a second magnetic attraction greater than and opposing the first magnetic attraction of the permanent magnet plunger only when a ground fault occurs to enable the biased contacts to be returned to the normally open position.

15. A method as in claim 14 wherein the step of biasing the contacts in the normally open position further comprises the steps of:

carrying the fixed contact on a structure;

carrying the moveable contact on a solenoid housing; and biasing the solenoid housing away from the structure with a spring external to the housing to hold the contacts in the normally open position.

16. The method of claim 15 wherein the step of selectively and manually closing the biased contacts and holding the contacts in the closed position comprises the steps of:

slidably extending the permanent magnet plunger through the structure into the solenoid housing;

placing a footplate of uniformly solid magnetic material in the base of the solenoid housing; and biasing the permanent magnet plunger away from the footplate with a force greater than the solenoid housing spring bias such that when the solid magnetic plunger is momentarily and manually forced against the footplate, the sole magnetic attraction between the footplate and the solid magnetic plunger holds the solenoid housing in fixed relation with the solid magnetic plunger causing the moveable contact to be forced by the spring biased permanent magnet plunger toward and in contact with the fixed contact.

17. The method of claim 16 wherein the step of generating the second magnetic attraction further comprises the step of:

forming the solenoid with a winding to cause a magnetic field opposing and greater than the sole magnetic attraction between the solid permanent magnet plunger and the solid footplate only when a ground fault occurs so as to enable the spring biased solenoid housing to force the moveable contact away from the fixed contact and open the contacts.

18. A method as in claim 17 wherein the step of biasing the solenoid housing further comprises the step of providing a first spring between the structure and the solenoid housing to bias the solenoid housing away from the structure to hold the contacts in the normally open position.

19. A method as in claim 18 wherein the step of biasing the permanent magnet plunger further comprises the step of providing a second spring between the permanent magnet plunger and the structure to bias the plunger away from the footplate.

20. A method as in claim 19 further comprising the step of generating a current through the solenoid coil only when a ground fault occurs to generate a magnetic field to open the contacts and interrupt the circuit.

21. A method as in claim 20 wherein the step of generating a current through the solenoid coil further comprises the steps of:

coupling one end of the solenoid coil to the first terminal;

coupling the second end of the solenoid coil to an electrical gate;

generating a signal when the ground fault occurs; and coupling the generated signal to the electrical gate to cause the gate to conduct momentarily and open the contacts.

22. A method as in claim 21 further comprising the step of using a silicon controlled rectifier as the gate.

23. A method as in claim 22 further comprising the step of manually resetting the contacts to the closed position after the ground fault is removed.

24. A method as in claim 23 further comprising the step of electrically resetting the contacts to the closed position after the ground fault is removed.

25. A method as in claim 24 wherein the steps of electrically resetting the contacts further comprises the steps of:

forming the solenoid with a second coil to cause a magnetic field aiding the magnetic attraction between the plungers and the footplate;

momentarily generating a second signal only when the ground fault is removed; and coupling the second signal to the second coil only momentarily for generating a magnetic field aiding the magnetic attraction between the permanent magnet plunger and the footplate and with a magnitude sufficient to overcome the bias on the solenoid housing so as to enable the biased solenoid housing to move toward the structure and the plunger and close the contacts.

26. Apparatus as in claim 5 wherein the means for preventing closure of the contacts until the reset button is released further comprises:

a base member separated from the reset button;

a reset check spring spaced between said base member and said reset button to keep the base member separated from the reset button; and a projection extending perpendicular to the base member for contacting the solenoid housing carrying the movable contact so as to prevent closure of said contacts until the reset button is released.

* * * * *